US009540775B2

(12) United States Patent
Heady

(10) Patent No.: US 9,540,775 B2
(45) Date of Patent: Jan. 10, 2017

(54) COMPOSITE HOOP TIE FOR CONCRETE

(71) Applicant: Power Brace LLC, Des Moines, IA (US)

(72) Inventor: Timothy P. Heady, Elkhart, IA (US)

(73) Assignee: Power Brace LLC, Des Moines, IA (US)

( * ) Notice: Subject to any disclaimer, the term of this patent is extended or adjusted under 35 U.S.C. 154(b) by 0 days.

(21) Appl. No.: 14/503,944

(22) Filed: Oct. 1, 2014

(65) Prior Publication Data

US 2016/0097169 A1 Apr. 7, 2016

(51) Int. Cl.

| | |
|---|---|
| ***E04C 5/16*** | (2006.01) |
| ***E01C 11/14*** | (2006.01) |
| ***E04C 5/20*** | (2006.01) |
| *E04B 1/48* | (2006.01) |

(52) U.S. Cl.

CPC ..... *E01C 11/14* (2013.01); *E04C 5/162* (2013.01); *E04C 5/20* (2013.01); *E04B 1/48* (2013.01)

(58) Field of Classification Search

CPC ..... E04B 1/41; E04B 2001/4192; E04B 1/48; E04C 5/20; E04C 5/162; E04C 11/14

USPC ..... 52/698, 702, 703, 712–715, 396.02,52/396.04, 396.05

See application file for complete search history.

(56) References Cited

U.S. PATENT DOCUMENTS 1,670,875 A * 5/1928 Bowers ..... 52/370
2,150,982 A * 3/1939 McFarland ..... E01C 11/14 404/62
2,192,508 A * 3/1940 Simpson ..... E02D 5/12 405/275
2,192,570 A * 3/1940 Bitney ..... E01C 11/14 404/62
2,244,337 A * 6/1941 Warren ..... 404/63
2,245,972 A * 6/1941 Friberg ..... E01C 11/14 404/63
2,319,050 A * 5/1943 Fischer ..... E01C 11/14 404/62
2,355,771 A * 8/1944 Cyrus ..... E01C 11/14 404/47
2,531,899 A * 11/1950 Webb ..... E01C 11/14 404/62
2,552,365 A * 5/1951 Bradbury ..... E01C 11/14 404/62
3,159,945 A * 12/1964 La Morte ..... 52/706
3,420,014 A * 1/1969 Courtois ..... E04B 1/4142 294/89
3,431,012 A * 3/1969 Eriksson et al. ..... 294/89
3,437,017 A * 4/1969 Walz ..... E01C 11/14 404/60
3,562,978 A * 2/1971 Ali-Oglu ..... 52/126.3
3,702,093 A * 11/1972 Van de Loock ..... E01C 11/14 404/62
3,993,341 A * 11/1976 Bentley ..... 294/89
4,250,664 A * 2/1981 Remke ..... A01G 23/04 206/423

(Continued)

*Primary Examiner* — Brent W Herring
(74) *Attorney, Agent, or Firm* — McKee, Voorhees & Sease, PLC

(57) ABSTRACT

A concrete tie is provided for joining together adjacent slabs of concrete. The tie includes a flat center portion which sits upon the subgrade, and opposite end portions which are inclined upwardly to extend into the concrete when the concrete is poured. The ties are made of a non-corrosive material to eliminate concrete spalling. The ties are formed as a continuous loop, with curved opposite ends.

13 Claims, 2 Drawing Sheets

(56) References Cited

U.S. PATENT DOCUMENTS

| | | | | | |
|---|---|---|---|---|---|
| 4,750,306 | A * | 6/1988 | Granieri | 52/251 | |
| 5,119,614 | A * | 6/1992 | Rex | E04C 5/0604 | 52/649.3 |
| 5,380,120 | A * | 1/1995 | Vermeulen | 52/63 | |
| 5,400,559 | A * | 3/1995 | Nicholas | 52/396.05 | |
| 5,699,875 | A * | 12/1997 | Dugan | 182/3 | |
| 5,802,802 | A * | 9/1998 | Wegler | 52/693 | |
| 5,870,869 | A * | 2/1999 | Schrader | 52/396.02 | |
| 5,896,722 | A * | 4/1999 | Swenson | E04C 5/163 | 403/391 |
| 5,899,043 | A * | 5/1999 | Reay | 52/707 | |
| 6,058,663 | A * | 5/2000 | MacKarvich | 52/167.3 | |
| 6,088,985 | A * | 7/2000 | Clark | E04C 2/044 | 52/309.11 |
| 6,185,897 | B1 * | 2/2001 | Johnson et al. | 52/583.1 | |
| 6,250,562 | B1 * | 6/2001 | Bruyn | 238/8 | |
| 6,655,105 | B2 * | 12/2003 | Swenson | E04C 5/163 | 403/391 |
| 7,441,984 | B2 * | 10/2008 | Kramer | 404/52 | |
| 7,481,031 | B2 * | 1/2009 | Boxall et al. | 52/396.02 | |
| 8,146,309 | B1 * | 4/2012 | Logemann et al. | 52/396.02 | |
| 2003/0024204 | A1 * | 2/2003 | Swenson | E04C 5/163 | 52/677 |
| 2003/0101678 | A1 * | 6/2003 | Snauwaert | 52/712 | |
| 2008/0222984 | A1 * | 9/2008 | Michiels | 52/396.05 | |
| 2009/0007512 | A1 * | 1/2009 | Kerrels | 52/396.02 | |
| 2012/0017535 | A1 * | 1/2012 | Beerens | 52/649.8 | |
| 2013/0174499 | A1 * | 7/2013 | Densmore et al. | 52/125.4 | |

* cited by examiner

COMPOSITE HOOP TIE FOR CONCRETE

BACKGROUND OF THE INVENTION

Concrete roadways are often constructed using a slip form paver which lays one lane of concrete, and then lays an adjacent lane of concrete, with a longitudinal joint between the adjacent lanes. Ties, such as rebar, are typically used at the longitudinal joint to tie the adjacent concrete slabs together. Rebar concrete ties are also used in other applications to connect adjacent concrete slabs. The rebars, which are made of steel, tend to corrode due to moisture, which leads to deterioration of the concrete. One alternative to minimize the corrosion is to coat the rebar with a non-corrosive material, such as epoxy. However, it is well documented in the road construction industry that the epoxy coating is often damaged, such as by bending the rebar, which ultimately leads to corrosion and damage to the concrete.

Therefore, the primary objective of the present invention is the provision of an improved concrete tie which eliminates corrosion and resulting concrete deterioration.

Another objective of the present invention is the provision of a non-corrosive tie for joining adjacent concrete slabs.

A further objective of the present invention is the provision of a continuous, composite hoop for use at the longitudinal joint of adjacent concrete road lanes.

Still another objective of the present invention is the provision of an improved composite tie for concrete joints which has a flat center portion to lie upon the subgrade and upwardly angled ends to reside in the concrete.

Another objective of the present invention is the provision of a composite concrete tie which is economical to manufacture, durable, and simple to use.

These and other objectives will become apparent from the following description of the invention.

SUMMARY OF THE INVENTION

The concrete tie of the present invention is preferably made of a non-corrosive, composite material, and is intended for use in joining adjacent slabs of concrete, such as at the longitudinal joint of adjacent concrete road lanes. In a preferred embodiment, the tie is in the form of a loop with a flat central portion and opposite, upwardly inclined ends. The center portion sits upon the subgrade and the ends extend into the concrete, when the concrete is poured. One or more cross braces may extend between the forward and rearward sides of the hoop tie for increased strength.

DETAILED DESCRIPTION OF THE PREFERRED EMBODIMENTS

Figure 1:
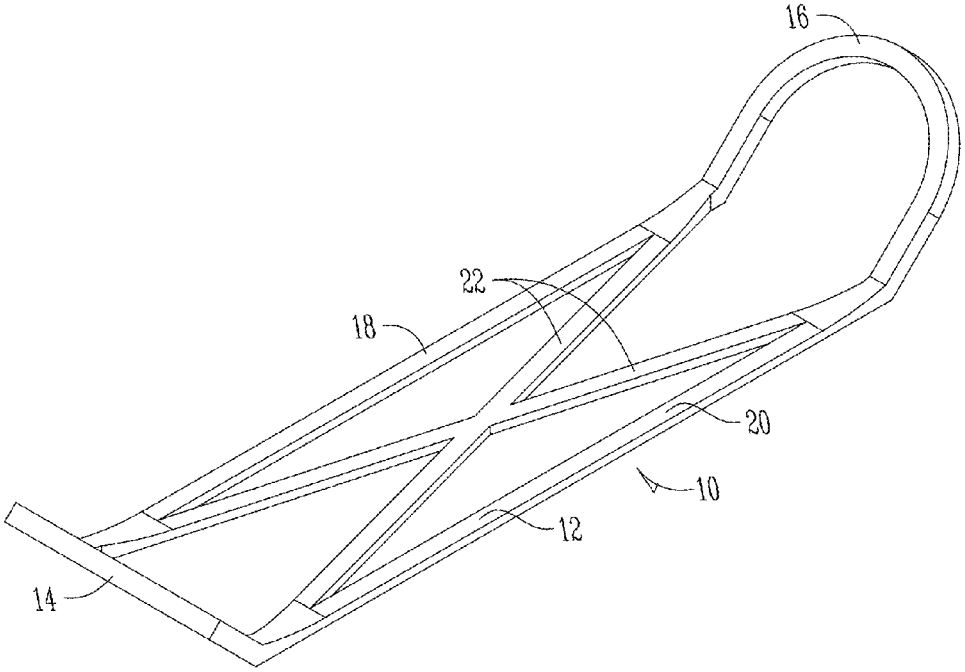
FIG. 1 is a perspective view of the hoop tie for use in concrete, according to the present invention.
Figure 2:
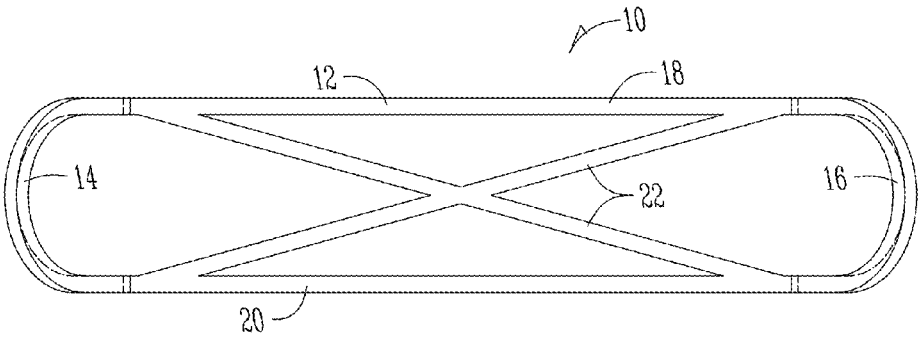
FIG. 2 is a top plan view of the hoop tie of the present invention.

The concrete tie of the present invention is generally designated by the reference numeral 10 in the drawings. The tie 10 includes a flat central portion 12 and opposite left and right, curved ends 14, 16 which are inclined upwardly from the central portion 12. The tie 10 includes opposite front and rear edges or sides 18, 20, with one or more cross braces 22 extending between the edges 18, 20. The cross braces 22 connect the opposite hoop ends of the tie 10, so as to minimize thickness of the central portion 12 and ends 14, 16, thereby providing a thin profile for the tie 10.

Figure 3:
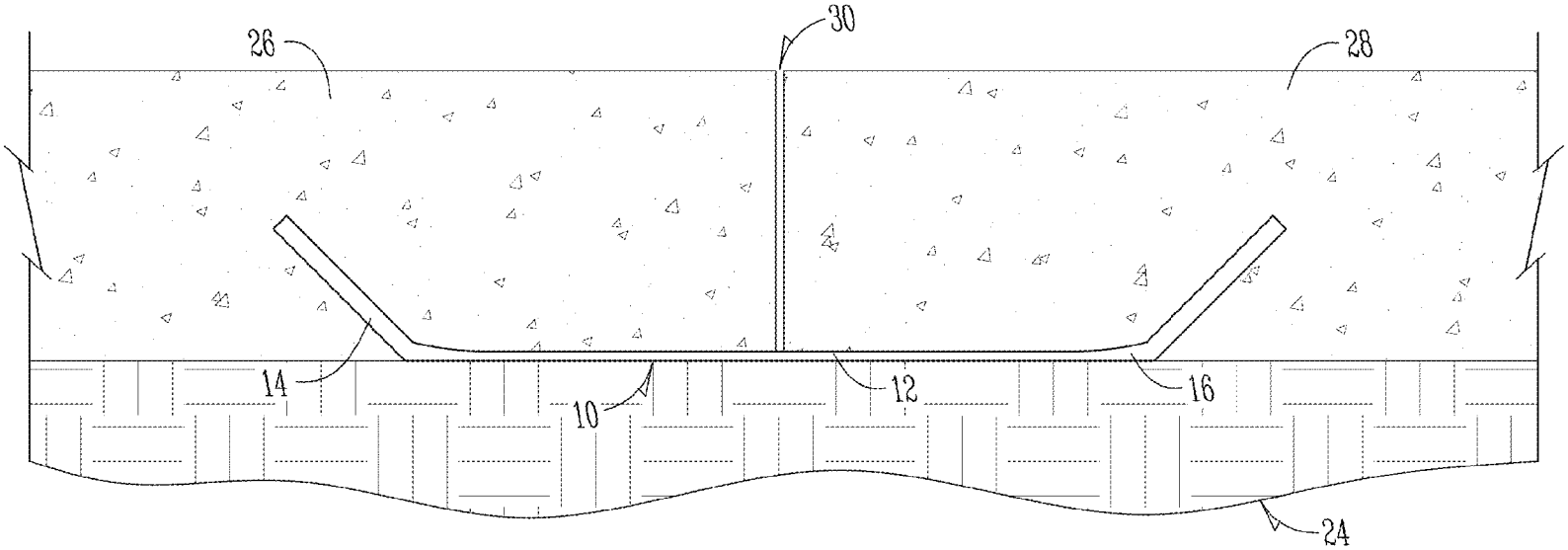
FIG. 3 is a sectional view showing the hoop tie in use at the longitudinal joint of adjacent concrete slabs, such as roadway lanes, to tie the slabs together.

As seen in FIG. 3, the ends 14, 16 extend at an angle of approximately 45° from the central portion 12 of the tie 10. This angle may be increased or decreased, without departing from the scope of the present invention. Also, the ends do not have to be planar, as shown in FIG. 3, but may also include bends or corrugations or have beads or ridges formed thereon. In a preferred embodiment, the central portion has a length of 3'-4' between the ends 14, 16, and the radii of the ends is preferably 3"-6".

The ties 10 are used on new concrete road construction and other new concrete applications. The ties 10 are set upon the subgrade 24 at spaced intervals so that the midpoint of each tie is aligned or positioned where the longitudinal joint 30 of the roadway lanes or slabs is to be formed. Thus, the central portion 12 of the tie 10 extends across the joint 30, with the ends 14, 16 inclined upwardly above the subgrade 24. The first slab or lane 26 can then be poured, such as with a slip form paver. The tread or track of the paver rides over the exposed central portion 12 of the tie 10 without damaging the tie 10. Then, the second slab or lane 28 of concrete is poured. When the concrete cures, the slabs or lanes 26, 28 are tied together by the plurality of ties 10 along the longitudinal concrete joint 30 to prevent separation of the slabs.

The ties 10 are made of a composite material, such as fiberglass, which is non-corrosive. The material may be resilient, such that the ends 16, 18 will return to their pre-formed angle if bent. Since ties 10 are made of a non-corrosive material, there is no risk of concrete deterioration due to corrosion, such as with steel rebar. The curved ends 14, 16 minimize or eliminate stress points, which are present at the ends of the conventional rebar ties. The tie 10 is not intended to be a load transfer device, and therefore would not typically be used at a transverse joint of a roadway.

Thus, it can be seen that the present invention accomplishes at least all of the stated objectives.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A concrete tie and adjacent slabs of concrete poured on a subgrade to form a joint between the slabs, the tie comprising:

a loop of non-corrosive material comprising:

(a) a flat central portion having opposing side edges positioned between and in direct contact with both the poured concrete and the subgrade; and (b) angled portions rigidly secured to the opposing side edges of the flat central portion at opposite ends of the flat central portion and inclined upwardly from opposite ends of the flat central portion, wherein the angled portions are in direct contact only with the poured concrete; and wherein the loop is continuous.

2. The concrete tie of claim 1 wherein the loop has a midpoint configured to be positioned beneath the joint between the adjacent slabs.

3. The concrete tie of claim 1 wherein the opposing side members further comprise two parallel side members and at least one cross brace extending between the opposing sides.

4. The concrete tie of claim 3 wherein the at least one cross brace comprises two cross braces arranged in a criss-cross configuration.

5. The concrete tie of claim wherein the loop is fiberglass.

6. The concrete tie of claim 1 wherein each of the angled portions is configured to be positioned within one of the adjacent slabs of concrete and on opposite sides of the joint.

7. The concrete tie of claim 1 wherein the ends are symmetrical to one another.

8. The concrete tie of claim 1 wherein the ends are inclined approximately 45° above horizontal.

9. The concrete tie of claim 1 wherein the central portion is planar.

10. The concrete tie of claim 1 wherein the ends are curved.

11. A concrete tie and adjacent slabs of concrete poured on a subgrade to form a joint between the slabs, the tie comprising:

a loop of non-corrosive material comprising:

(a) a flat central portion having opposing side edges positioned between and in direct contact with both the poured concrete and the subgrade; and (b) angled portions rigidly secured to the opposing side edges of the flat central portion at opposite ends of the flat central portion and inclined upwardly from opposite ends of the flat central portion, wherein the angled portions are in direct contact only with the poured concrete;

wherein the loop is continuous and homogeneous;

wherein the loop has a midpoint configured to be positioned beneath the joint between the adjacent slabs; and wherein the opposing side members further comprise two parallel side members and at least one cross brace extending between the opposing sides.

12. The concrete tie of claim 11 wherein each of the angled portions further comprise corrugations, beads or ridges formed thereon and configured to improve adhesion of poured concrete with the angled portions of the concrete tie.

13. The concrete tie of claim 11 wherein the loop is fiberglass.

* * * * *